US008856984B1

(12) United States Patent
Donham

(10) Patent No.: US 8,856,984 B1
(45) Date of Patent: Oct. 14, 2014

(54) FITTED SHEET AND INTEGRATED HOLDING APPARATUS

(71) Applicant: Jacqueline Donham, Topeka, KS (US)

(72) Inventor: Jacqueline Donham, Topeka, KS (US)

( * ) Notice: Subject to any disclaimer, the term of this patent is extended or adjusted under 35 U.S.C. 154(b) by 0 days.

(21) Appl. No.: 14/276,033

(22) Filed: May 13, 2014

(51) Int. Cl.
*A47G 9/04* (2006.01)
*A47G 9/02* (2006.01)

(52) U.S. Cl.
CPC ..... *A47G 9/04* (2013.01); *A47G 9/0246* (2013.01)
USPC ..... 5/496; 5/497

(58) Field of Classification Search
USPC ..... 5/496, 495, 497–499, 482; 24/72.5
See application file for complete search history.

(56) References Cited

U.S. PATENT DOCUMENTS

| | | | | | |
|---|---|---|---|---|---|
| 2,284,778 | A | | 6/1942 | Treiber | |
| 2,886,833 | A | * | 5/1959 | Enger | 5/496 |
| 4,461,049 | A | | 7/1984 | Hammond | |
| 4,495,233 | A | * | 1/1985 | Bassetti | 428/81 |
| 4,642,826 | A | * | 2/1987 | Bassetti | 5/496 |
| 4,727,608 | A | * | 3/1988 | Joyce | 5/497 |
| 4,777,894 | A | * | 10/1988 | Joyce | 112/475.08 |
| 4,937,904 | A | | 7/1990 | Ross | |
| 4,970,744 | A | * | 11/1990 | Davis | 5/496 |
| 5,020,177 | A | * | 6/1991 | Etherington | 5/496 |
| 5,029,353 | A | | 7/1991 | Kimball et al. | |
| 5,046,207 | A | * | 9/1991 | Chamberlain | 5/496 |
| 5,072,470 | A | | 12/1991 | Lysiak | |
| 5,628,077 | A | * | 5/1997 | Briganti | 5/496 |
| 5,809,593 | A | | 9/1998 | Edwards | |
| 7,530,124 | B1 | | 5/2009 | Wootten, Jr. | |
| 7,703,156 | B2 | * | 4/2010 | Lee | 5/500 |
| 8,607,383 | B2 | | 12/2013 | Briganti | |
| 2004/0031100 | A1 | | 2/2004 | Creech | |
| 2008/0028522 | A1 | * | 2/2008 | Atwood | 5/496 |
| 2008/0155749 | A1 | * | 7/2008 | Stevens | 5/496 |
| 2009/0126109 | A1 | * | 5/2009 | Lee | 5/421 |
| 2011/0314604 | A1 | | 12/2011 | Hoo | |
| 2012/0324646 | A1 | * | 12/2012 | Briganti | 5/496 |

* cited by examiner

*Primary Examiner* — Robert G Santos
(74) *Attorney, Agent, or Firm* — Dale J. Ream

(57) ABSTRACT

A fitted sheet and integrated holding apparatus includes a fabric sheet having a top panel, a pair of opposed side panels, and a pair of opposed end panels extending therebetween. The fabric may be fitted to the mattress and configured to fold flat when removed therefrom. Connection of respective side panels and respective end panels form four corner sections each having a corner edge. Each corner section includes a cord channel situated along a respective corner edge and defining opposed open ends and an interior space extending between the open ends. The holding apparatus includes an elastic cord having a flexible configuration and opposed cord ends, the cord extending through the interior space of the cord channel and respective cord ends extending outwardly through respective open ends. A pair of cord fasteners is attached to respective cord ends and, when coupled together, tightens a respective corner section to the mattress.

20 Claims, 7 Drawing Sheets

FITTED SHEET AND INTEGRATED HOLDING APPARATUS

BACKGROUND OF THE INVENTION

This invention relates generally to fitted sheets and, more particularly, to a fitted sheets and integrated holding apparatus that includes four corner sections that may be selectively tightened about respective corner sections of a mattress and selectively coupled to box springs of a traditional bed set or to the base of an adjustable bed.

Tossing, turning, or repeatedly rolling over while sleeping in a bed often results in undesirable shifting of a fitted sheet on a mattress. For instance, one corner of a fitted sheet may shift or become dislodged so as to expose the mattress itself or to become uncomfortably tangled under a person sleeping on the mattress. This is especially a problem for sheets fitted to an adjustable angle bed. When either the upper or lower segments are angled (or both), the center portion of the fitted sheet tends to come loose and can lead to the problems discussed above.

Most fitted sheets are characterized by having an elastic material sewn into the edges of the sheet to draw the sheet together underneath edges of the mattress. Further, this type of sheet would have elastic in the perimeter edges that define corner sections so as to more securely grip corners of the mattress. Other devices and configurations have been introduced in the prior art in attempts to more securely attach a fitted sheet to a mattress, such as those disclosed in U.S. Pat. No. 5,072,470; U.S. Pat. No. 4,937,904; U.S. Pat. No. 7,530, 124 and U.S. Pat. No. 5,809,593. Although assumably effective for their intended purposes, the existing sheet designs do not have structures by which the corner sections may be tightened after the sheet is spread out on a mattress and by which the center edges of the sheet may be coupled to a box springs unit. In addition, sheets having elastic edges and corners have the distinct disadvantage of not laying flat for storage purposes.

Therefore, it would be desirable to have a fitted sheet having an integrated holding apparatus that enables a user to tighten each corner section around a respective corner of a mattress. Further, it would be desirable to have a fitted sheet having an integrated holding apparatus that is selectively coupled to the box spring unit of a mattress/box spring set so as to securely maintain the sheet in an appropriate position on the mattress. In addition, it would be desirable to have a fitted sheet having an integrated holding apparatus that folds flat for storage when removed from the mattress.

SUMMARY OF THE INVENTION

A fitted sheet and integrated holding apparatus according to the present invention includes a fabric sheet having a generally rectangular configuration that includes a top panel, a pair of opposed side panels, and a pair of opposed end panels extending between ends of respective side panels. The fabric may be fitted to the mattress and configured to fold flat when removed from the mattress. Connection of respective side panels and respective end panels form four corner sections having substantially identical configurations, each corner section having a corner edge. Each corner section includes a cord channel situated along a respective corner edge, the cord channel defining opposed open ends and an interior space extending between the open ends.

The holding apparatus includes an elastic cord having a flexible linear configuration and opposed cord ends, the cord extending through the interior space of the cord channel and respective cord ends extending outwardly through respective open ends. A pair of cord fasteners is attached to respective cord ends, one respective cord fastener selectively coupled to another respective fastener and configured to tighten a respective corner section to the mattress.

Therefore, a general object of this invention is to provide a fitted sheet with an integrated holding apparatus for securing a fitted sheet to a mattress.

Another object of this invention is to provide a fitted sheet with an integrated holding apparatus, as aforesaid, in which four corner sections can be independently tightened around respective mattress corners.

Still another object of this invention is to provide a fitted sheet with an integrated holding apparatus, as aforesaid, in which side edges proximate a center area of the sheet may be coupled to the box springs of the bed.

Yet another object of this invention is to provide a fitted sheet with an integrated holding apparatus, as aforesaid, that folds flat when removed from a mattress.

A further object of this invention is to provide a fitted sheet with an integrated holding apparatus, as aforesaid, that is easy for a single person to attach to or remove from a mattress.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
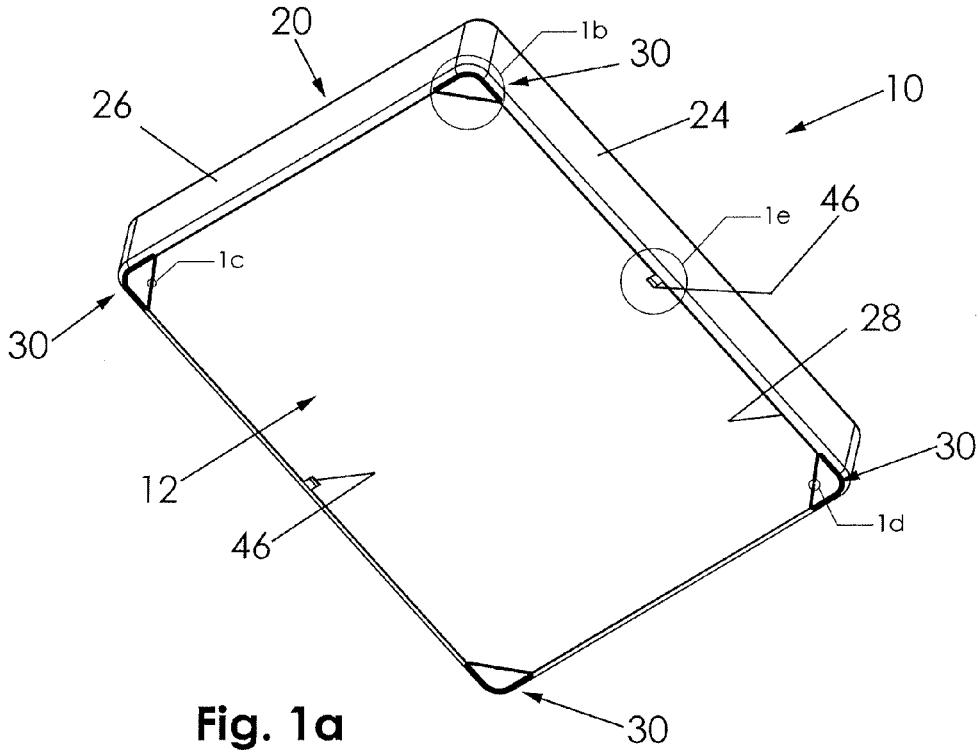
FIG. 1*a* is a perspective view of a fitted sheet with integrated holding apparatus according to a preferred embodiment of the present invention illustrating a fitted sheet coupled to a mattress.
Figure 1F:
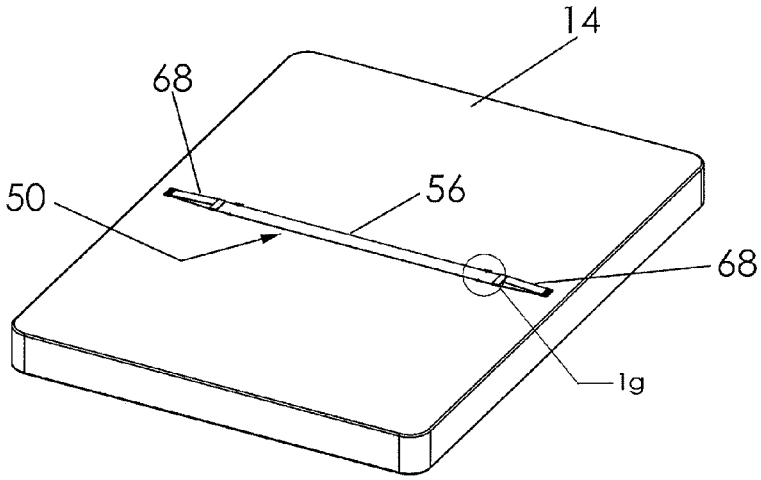
FIG. 1*f* is a perspective view of the sheet stay of the present invention coupled to a box spring unit.

A fitted sheet and integrated holding apparatus according to the present invention will now be described in detail with reference to FIGS. 1*a* to 4*b* of the accompanying drawings. The fitted sheet and integrated holding apparatus 10 is intended for use with a mattress and either a box springs 14 or base 18 of an adjustable bed 16. Accordingly, the fitted sheet and integrated holding apparatus 10 includes a fabric sheet 20 configured to be fitted to the mattress 12 and that defines four corner sections 30. Each corner section 30 includes a cord channel 34 defining an interior space 38 through which an elongate elastic cord 40 extends. Opposed free ends 42 of a respective cord 40 include cord fasteners 44 that when coupled together cause a respective corner section 30 to be tightened to a corner of the mattress. All of these structures will now be described in more detail below. The present invention is primarily for use with a traditional mattress 12 and also with either a box springs 14 (FIG. 1*f*) or an adjustable bed 16 (FIG. 5) as will be described in turn below.

The fabric sheet 20 includes a generally rectangular configuration that includes a top panel 22, a pair of opposed side panels 24, and a pair of opposed end panels 26 that extend between respective side panels 24 (FIG. 1*a*). The fabric sheet 20 is configured to be fitted to a mattress 12 in a generally traditional manner but has a unique and integrated holding apparatus to be fitted securely to the mattress 12 while enabling the fabric sheet 20 to be folded flat when removed from the mattress 12 unlike traditional fitted sheets.

The integrated connection of the side panels 24 and end panels 26 form four corner sections 30 having substantially identical configurations. Each corner section 30 is characterized by having a corner edge 32. It is understood that the corner edges, as with a complete peripheral edge 28 of the fabric sheet 20, are configured to lay on the bottom of the mattress 12 when the fabric sheet 20 is fitted onto the mattress 12 (FIG. 1*a*).

Figure 1B:
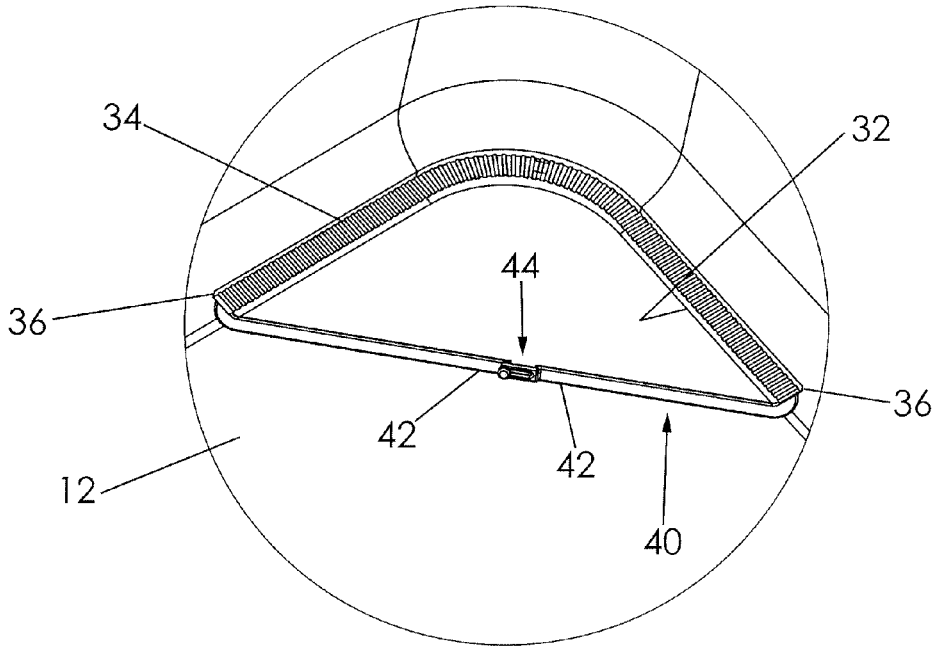
FIG. 1*b* is an isolated view on an enlarged scale taken from FIG. 1*a;*
Figure 1C:
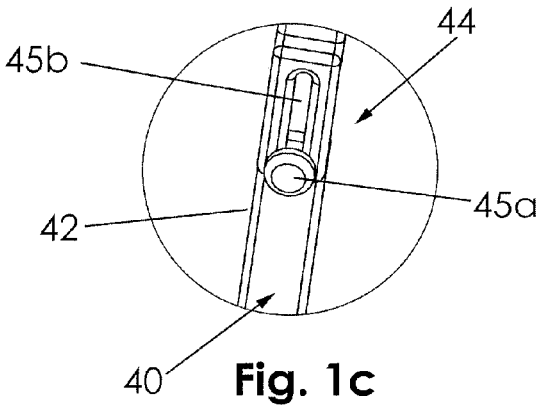
FIG. 1*c* is an isolated view on an enlarged scale taken from FIG. 1*b* illustrating a fastening apparatus in a coupled configuration.
Figure 1D:
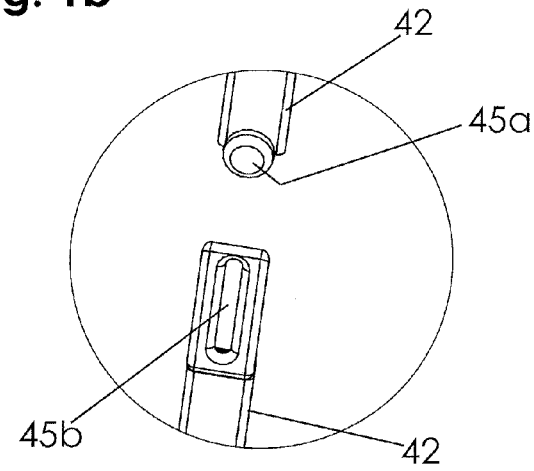
FIG. 1*d* is an isolated view on an enlarged scale taken from FIG. 1*b* illustrating the fastening apparatus in a released configuration.
Figure 1E:
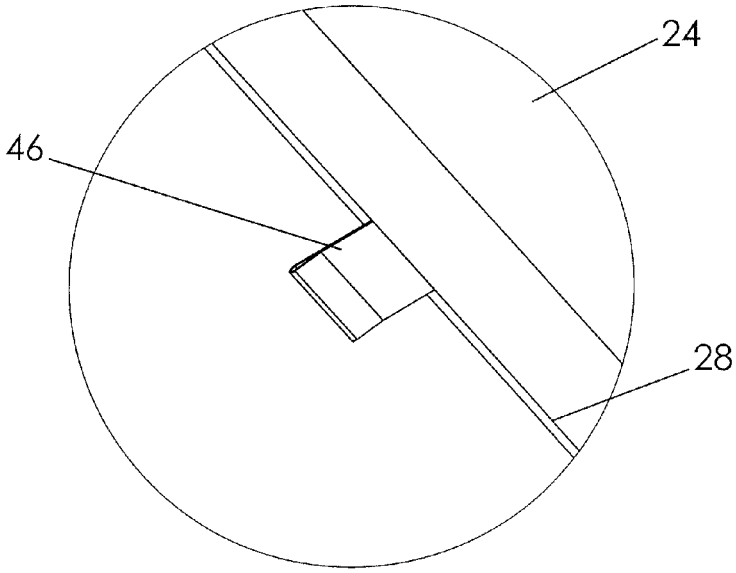
FIG. 1*e* is an isolated view on an enlarged scale taken from FIG. 1*a;*

Each corner section 30 includes a cord channel 34 situated along a respective corner edge 32 (FIG. 1*b*). Accordingly, a portion of a respective cord channel 34 is adjacent a respective side panel 24, another portion of the respective cord channel 34 is adjacent a respective end panel 26, and the respective cord channel portions are connected at the junction of respective adjacent side and end panels. The cord channel 34 may be constructed of twill tape or the like. A respective cord channel 34 defines opposed open ends 36 and an interior space 38 spanning between the open ends 36. The hollow interior space 38 can best be seen in FIG. 2*c*. Preferably, a cord channel 34 may be constructed using twill tape although other materials having a similar durable yet flexible characteristic would also be suitable.

A cord 40 constructed of flexible and elastic material is situated within each cord channel 34. More particularly, a respective cord 40 has an elongate configuration and includes opposed ends 42. Each free end 42 of a cord 40 extends outwardly through respective open ends 36 of the cord channel 34. In fact, the entire cord 40 may be slidably removed from the cord channel 34, such as to store or replace the cord 40. A cord fastener 44 is attached to each opposed end 42 of the cord 40, the cord fasteners 44 being configured to be selectively coupled together or released. It is understood that when respective cord fasteners 44 are coupled together, the cord 40 is stretched or tightened within the cord channel 34 so as to tighten a respective corner section 30 about a corner of the mattress 12. Conversely, when the cord fasteners 44 are released from one another, the cord 40 is loosened relative to a corner of the mattress 12.

It should be appreciated that when respective cord fasteners 44 are released from one another such that a respective cord channel 34 is loosened, respective corner sections 30 lie flat such that the entire fabric sheet 20 may be folded flat for storage. This is an advantage over traditional fitted sheets having elastic corner sections that remain bunched up when the fitted sheet is removed from a mattress.

With further reference to the cord fasteners 44, a pair of cord fasteners 44 may be a button 45*a* and button hole 45*b* combination although use of fasteners taken from a group that includes hook and loop fasteners, clasps, buckles, button and button hole combination, snaps, hooks, laces, and magnets would also be suitable.

Figure 3A:
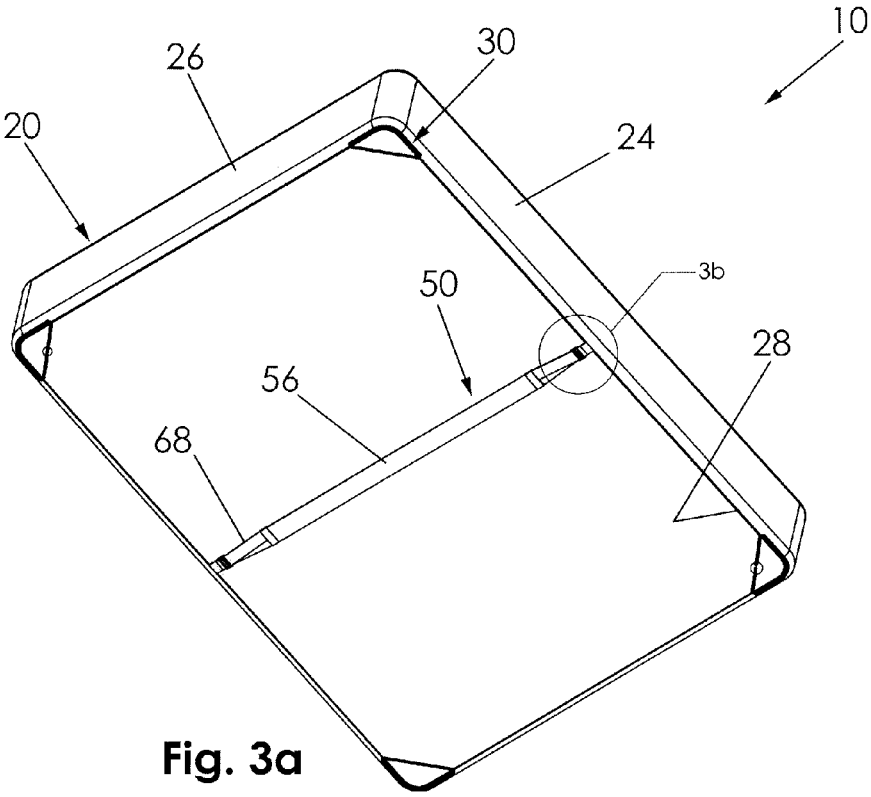
FIG. 3*a* is a perspective view of a fitted sheet with integrated holding apparatus according to a preferred embodiment of the present invention illustrating a fitted sheet with stay member coupled to a mattress.
Figure 3B:
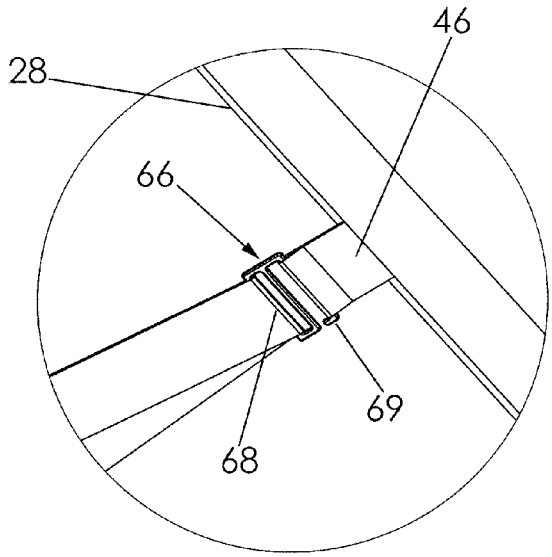
FIG. 3*b* is an isolated view on an enlarged scale taken from FIG. 3*a;*

Each side panel 24 of the fabric sheet 20 includes a peripheral edge 28. To be clear, the peripheral edge 28 is continuous and defines an opening through which the bottom side of the mattress 12 can be seen and accessed when the fabric sheet 20 is fitted to the mattress 12 (FIGS. 1*a* and 3*a*). The fabric sheet 20 includes a stay strap interface 46 coupled to the peripheral edge 28 adjacent each side panel 24 about midway between each end panel 26 (FIGS. 3*a* and 3*b*). Each stay strap interface 46 may be a strap having a looped end to which a clip or hook may be coupled as will be described in more detail below.

Figure 4A:
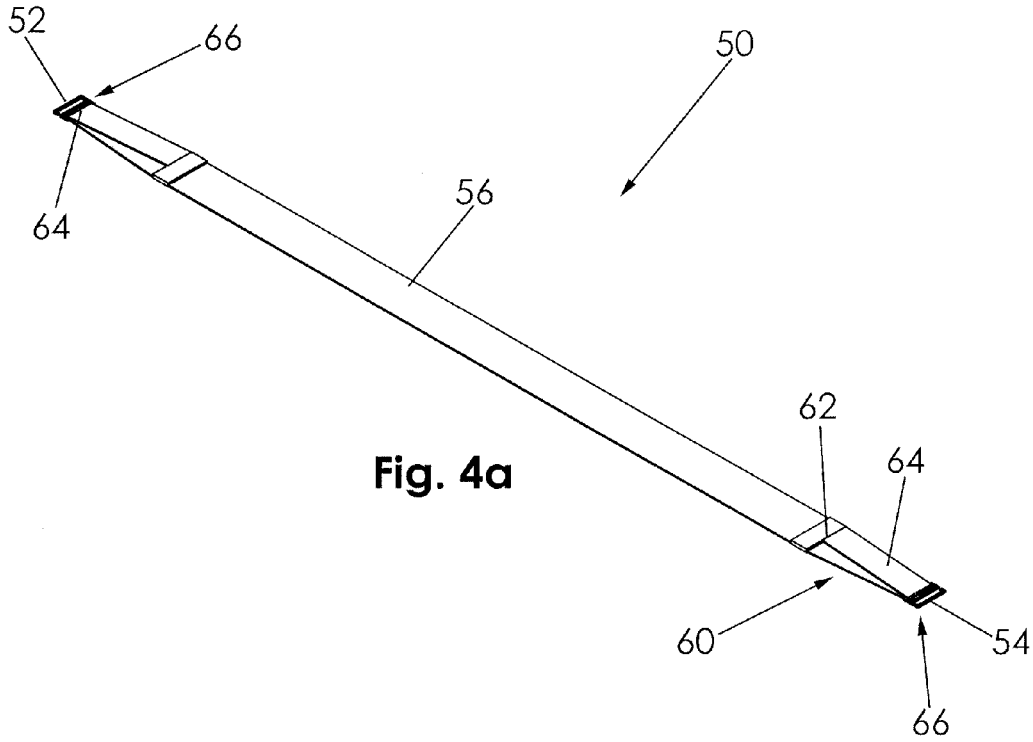
FIG. 4*a* is a perspective view on an enlarged scale of the stay member as in FIG. 3*b;*
Figure 5:
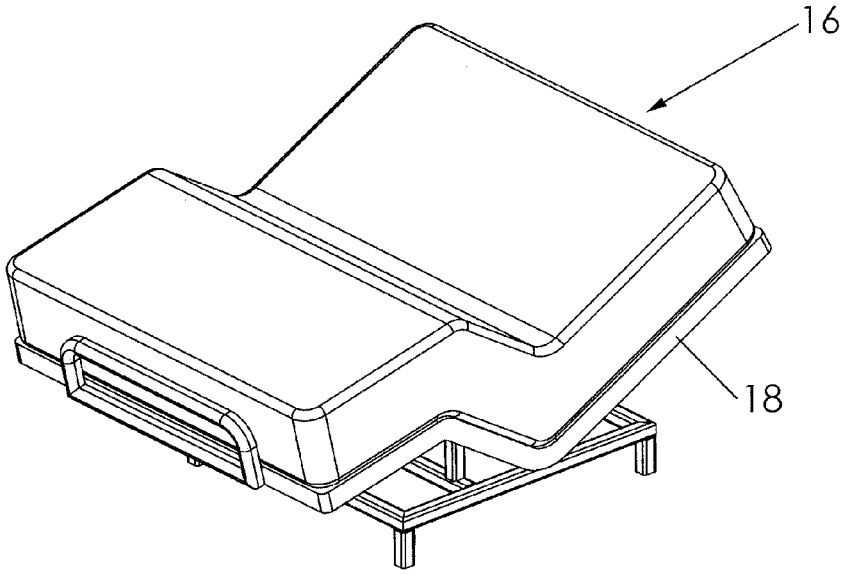
FIG. 5 is a perspective view of an adjustable bed in use with the present invention.

The fitted sheet and integrated holding apparatus 10 includes a stay strap 50 having an elongate and generally linear configuration (FIG. 4*a*). The stay strap 50 includes opposed first 52 and second 54 ends that are selectively and operatively coupled to the stay strap interfaces 46, respectively (FIG. 3*a*). When the stay strap 50 is coupled to the stay strap interfaces 46, the stay strap 50 spans the bottom side of the mattress 12 and tightly secures the sheet 20 to the mattress 12. The stay strap 50 may also be referred to as a center stay strap 50 in that it is configured to extend across the center portion of a mattress 12 when coupled to the stay strap interfaces 46.

Figure 1G:
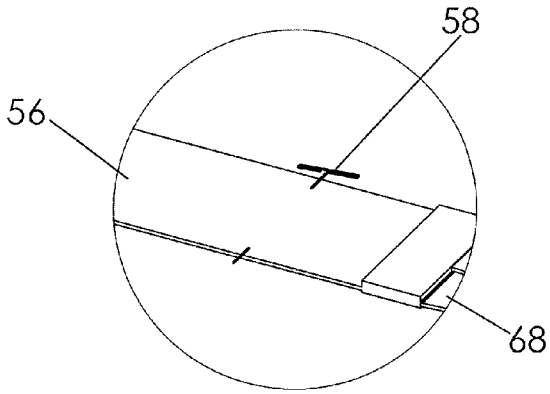
FIG. 1*g* is an isolated view on an enlarged scale taken from FIG. 1*f;*
Figure 2A:
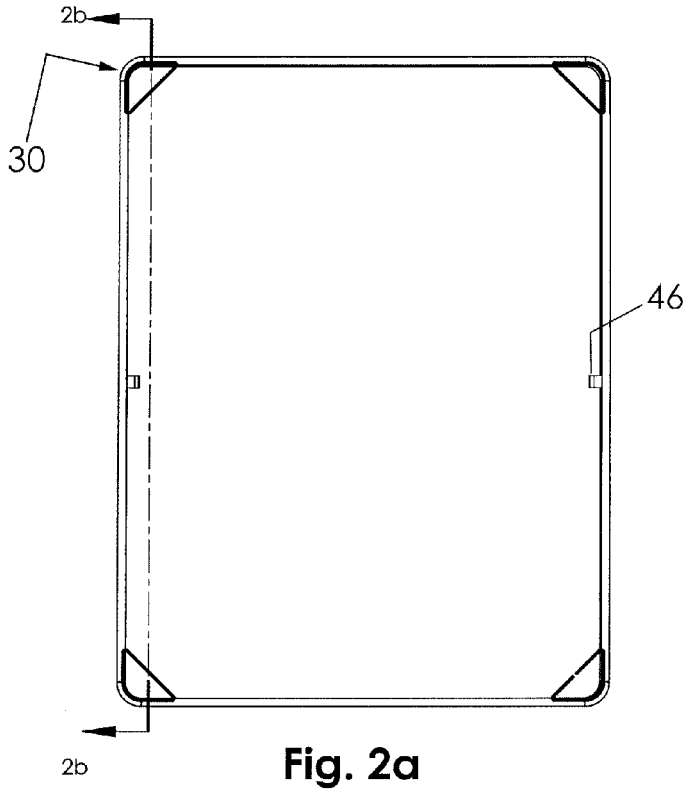
FIG. 2*a* is a bottom view of the fitted sheet mounted on a mattress as in FIG. 1*a;*
Figure 2B:
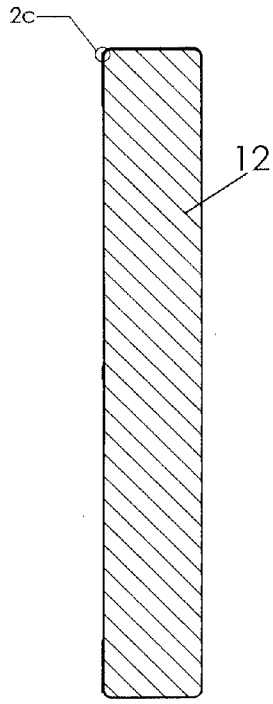
FIG. 2*b* is a sectional view taken along line 2*b*-2*b* of FIG. 2*a;*
Figure 2C:
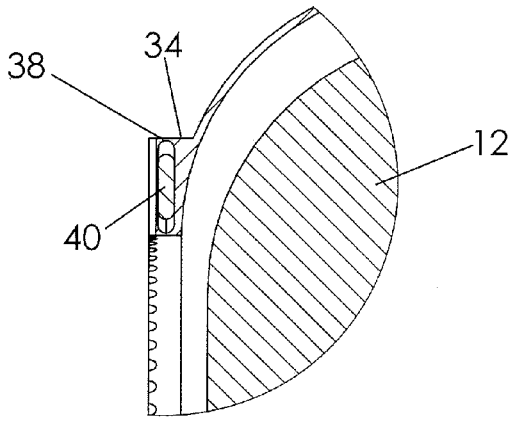
FIG. 2*c* is an isolated view on an enlarged scale taken from FIG. 2*a;*

The stay strap 50 may be coupled to the box springs 14 of a bed set (e.g. mattress and box springs) or to the base 18 of an adjustable bed 16. More particularly, the stay strap 50 includes a center section 56 having a fixed length and an elongate linear configuration (FIG. 4*a*). In other words, the center section 56 is non-elastic and non-length adjustable. Preferably, the center section 56 is constructed of grosgrain ribbon. In one embodiment, the center section 56 of the stay strap 50 may be coupled to a box springs 14 with durable fastening members 58, such as with T-pins (FIG. 1*g*).

Figure 4B:
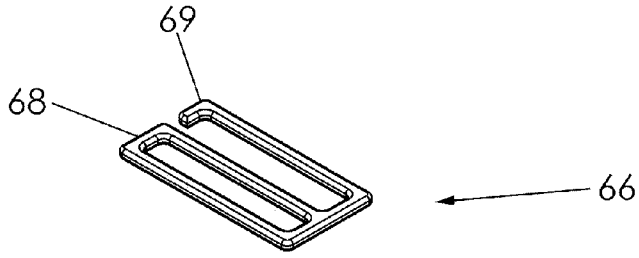
FIG. 4*b* is an isolated view of a stay member fastener of FIG. 3*b* on an enlarged scale.

The stay strap 50 may also include a pair of variable length sections 60, each variable length section 60 having a proximal end 62 coupled to a respective end of the center section 56 and a distal end 64 displaced from the center section 56 (FIG. 4*a*). The stay strap 50 also includes a pair of center stay fastening members 66 coupled to respective distal ends 64 of the variable length sections 60. Each center stay fastening member 66 may include a first portion 68 (FIG. 3*b*) sewn or otherwise integrated into a respective distal end 64 of a respective variable length section 60 and a second portion 69 that is configured to be releasably coupled to a respective stay strap interface 46. Preferably, the center stay fastening member 66 is a clip as shown in FIG. 4*b* but may also be taken from the group that includes hook and loop fasteners, clasps, buckles, snaps, hooks, laces, and magnets.

In use, the fitted sheet and integrated holding apparatus 10 may be fitted onto a mattress 12 as well as secured to traditional box springs 14 or to a base 18 of an adjustable bed 16.

Specifically, the fabric sheet 20 may be positioned atop a mattress 12 while respective cords 40 remain unfastened. Once positioned to cover the mattress, respective cord fasteners 44 of respective cords 40 positioned in respective cord channels 34 may be coupled so as to impart tension or grip around respective corners of the mattress 12 (FIGS. 1*a* and 1*b*). This unique configuration makes it easy for one person to fit the sheet to a mattress.

In addition, the center stay strap 50 may be coupled to a box springs 14 as described above. In fact, the center stay strap 50 may be permanently coupled to the box springs 14 with T-pins and then just disconnected from respective stay strap interfaces 46 whenever the fabric sheet 20 is removed from the mattress 12, such as for laundering. When the fabric sheet 20 is again fitted to the mattress 12, the center stay strap fasteners 66 may be coupled to respective interfaces 46 as described above.

Accordingly, the fitted sheet and integrated holding apparatus 10 enables the corner sections 30 of the fabric sheet 20 to be individually and optionally tightened about respective corners of a mattress 12, the sides of the fabric sheet 20 to be tightened toward one another using the stay strap 50, and the fabric sheet 20 to be folded flat when the cords 40 are unfastened or removed.

It is understood that while certain forms of this invention have been illustrated and described, it is not limited thereto except insofar as such limitations are included in the following claims and allowable functional equivalents thereof.

The invention claimed is:

1. A fitted sheet and integrated holding apparatus for use with a mattress and either a box springs or base of an adjustable bed, comprising:

a fabric sheet having a generally rectangular configuration that includes a top panel, a pair of opposed side panels, and a pair of opposed end panels extending between ends of respective side panels;

wherein said fabric sheet is selectively fitted to the mattress;

wherein connection of respective side panels and respective end panels form four corner sections having substantially identical configurations, each corner section having a corner edge;

wherein each corner section includes a cord channel situated along a respective corner edge, said cord channel defining opposed open ends and an interior space extending between said open ends;

an elastic cord having opposed cord ends, said cord extending through said interior space of said cord channel and respective cord ends extending outwardly through respective open ends;

a pair of cord fasteners attached to respective cord ends, one respective cord fastener selectively coupled to another respective cord fastener so as to tighten a respective corner section when fitted to the mattress.

2. The fitted sheet and integrated holding apparatus as in claim 1, wherein each said cord channel is constructed of twill tape.

3. The fitted sheet and integrated holding apparatus as in claim 1, wherein said pair of cord fasteners are taken from the group that includes hook and loop fasteners, clasps, buckles, button and button hole combination, snaps, hooks, laces, and magnets.

4. The fitted sheet and integrated holding apparatus as in claim 1, wherein each side panel of said fabric sheet includes a perimeter edge; and said fitted sheet further comprising a stay strap interface coupled to said perimeter edge about midway between respective opposed end panels.

5. The fitted sheet and integrated holding apparatus as in claim 4, comprising:

an elongate stay strap having opposed first and second ends operatively coupled to said stay strap interfaces, respectively;

wherein said stay strap is selectively coupled to one of the box springs or the base of the adjustable bed.

6. The fitted sheet and integrated holding apparatus as in claim 5, wherein said stay strap includes:

a center section having a fixed length and an elongate linear configuration;

a pair of variable length sections constructed of an elastic material, each variable length section having a proximal end coupled to a respective end of said center section and a distal end displaced from said center section;

a pair of center stay fastening members coupled to said distal ends of said variable length sections, respectively.

7. The fitted sheet and integrated holding apparatus as in claim 6, wherein each center stay fastening member includes a first portion sewn into a respective distal end of said variable length section of said stay strap and a second portion selectively and releasably coupled to a respective stay strap interface.

8. The fitted sheet and integrated holding apparatus as in claim 7, wherein said center stay fastening member is taken from the group that includes hook and loop fasteners, clasps, buckles, a button and button hole combination, snaps, hooks, laces, and magnets.

9. The fitted sheet and integrated holding apparatus as in claim 7, wherein said center section of said stay strap is constructed of grosgrain ribbon.

10. The fitted sheet and integrated holding apparatus as in claim 6, wherein said center section of said stay strap is constructed of grosgrain ribbon.

11. The fitted sheet and integrated holding apparatus as in claim 6, wherein said center section of said stay strap is releasably coupled to the box springs or the base of the adjustable bed with at least one T-pin.

12. The fitted sheet and integrated holding apparatus as in claim 1, wherein said fabric sheet is configured to fold flat when removed from the mattress.

13. A fitted sheet and integrated holding apparatus for use with a mattress and either a box springs or base of an adjustable bed, comprising:

a fabric sheet having a generally rectangular configuration that includes a top panel, a pair of opposed side panels, and a pair of opposed end panels extending between ends of respective side panels;

wherein:

said fabric sheet is selectively fitted to the mattress;

said fabric sheet is configured to fold flat when removed from the mattress;

connection of respective side panels and respective end panels form four corner sections having substantially identical configurations, each end section having a corner edge;

each corner section includes a cord channel situated along a respective corner edge, said cord channel defining opposed open ends and an interior space extending between said open ends;

an elastic cord having a flexible linear configuration and opposed cord ends, said cord extending through said interior space of said cord channel and respective cord ends extending outwardly through respective open ends;

a pair of cord fasteners attached to respective cord ends, one respective cord fastener selectively coupled to another respective fastener to tighten a respective corner section when fitted to the mattress.

14. The fitted sheet and integrated holding apparatus as in claim 13, wherein said pair of cord fasteners are taken from the group that includes hook and loop fasteners, clasps, buckles, button and button hole combination, snaps, hooks, laces, and magnets.

15. The fitted sheet and integrated holding apparatus as in claim 13, wherein each side panel of said fabric sheet includes a perimeter edge;

said fitted sheet and integrated holding apparatus comprising a stay strap interface coupled to said perimeter edge about midway between respective opposed end panels.

16. The fitted sheet and integrated holding apparatus as in claim 15, comprising:

an elongate stay strap having opposed first and second ends operatively coupled to said stay strap interfaces, respectively;

wherein said stay strap is selectively coupled to one of the box springs or the base of the adjustable bed.

17. The fitted sheet and integrated holding apparatus as in claim 16, wherein said stay strap includes:

a center section having a fixed length and an elongate linear configuration; and a pair of variable length sections constructed of an elastic material, each variable length section having a proximal end coupled to a respective end of said center section and a distal end displaced from said center section;

a pair of center stay fastening members coupled to said distal ends of said variable length sections, respectively.

18. The fitted sheet and integrated holding apparatus as in claim 17, wherein each center stay fastening member includes a first portion sewn into a respective distal end of said variable length section of said center stay strap and a second portion configured to releasably hook onto a respective stay strap interface.

19. The fitted sheet and integrated holding apparatus as in claim 18, wherein said center stay fastening member is taken from the group that includes hook and loop fasteners, clasps, buckles, a button and button hole combination, snaps, hooks, laces, and magnets.

20. The fitted sheet and integrated holding apparatus as in claim 17, wherein said center section of said stay strap is releasably coupled to said box springs or the base of the adjustable bed with at least one T-pin.

* * * * *